US005942087A

United States Patent [19]

Pruszynski

[11] Patent Number: 5,942,087

[45] Date of Patent: Aug. 24, 1999

[54] STARCH RETENTION IN PAPER AND BOARD PRODUCTION

[75] Inventor: Przemyslaw Pruszynski, Burlington, Canada

[73] Assignee: Nalco Chemical Company, Naperville, Ill.

[21] Appl. No.: 09/024,769

[22] Filed: Feb. 17, 1998

[51] Int. Cl.[6] ..... D21F 11/00; D21F 1/66; D21H 11/00

[52] U.S. Cl. ..... 162/175; 162/190; 162/183; 162/181.8

[58] Field of Search ..... 162/175, 183, 162/181, 190, 158, 181.8

[56] References Cited

U.S. PATENT DOCUMENTS

| | | | |
|---|---|---|---|
| 3,884,755 | 5/1975 | Frost, III | 162/190 |
| 4,066,495 | 1/1978 | Voigt et al. . | |
| 4,388,150 | 6/1983 | Sunden et al. . | |
| 4,609,432 | 9/1986 | Brucato | 162/141 |
| 4,749,444 | 6/1988 | Lorz et al. . | |
| 4,889,594 | 12/1989 | Gavelin | 162/130 |
| 4,902,382 | 2/1990 | Sakabe et al. . | |
| 4,913,775 | 4/1990 | Langley et al. . | |
| 5,002,633 | 3/1991 | Maxham | 162/5 |
| 5,185,062 | 2/1993 | Begala . | |
| 5,501,774 | 3/1996 | Burke . | |
| 5,571,380 | 11/1996 | Fallon . | |
| 5,595,629 | 1/1997 | Begala . | |
| 5,629,368 | 5/1997 | Chung . | |
| 5,670,021 | 9/1997 | Owens . | |
| 5,676,796 | 10/1997 | Cutts | 162/158 |
| 5,779,859 | 7/1998 | Carter et al. | 162/183 |

FOREIGN PATENT DOCUMENTS

| | | |
|---|---|---|
| 0 361 763 | 4/1990 | European Pat. Off. . |
| 812896 | 1/1985 | Finland . |
| WO 95/33096 | 12/1995 | WIPO . |

OTHER PUBLICATIONS

Pulp and Paper Manufacture v3. Papermaking and Paperboard Making, Ronald G. MacDonald, Mar. 28, 1973.

*Primary Examiner*—Peter Chin
*Assistant Examiner*—Kevin Cronin
*Attorney, Agent, or Firm*—Hill & Simpson

[57] ABSTRACT

A process for manufacturing paper and paperboard that includes the steps of preflocculating granular starch with an aqueous solution containing cellulosic fibers and a flocculant prior to the introduction of the preflocculated mixture to either the white water, thick stock or thin stock. By preflocculating the starch in the presence of cellulosic fibers, improved formation is provided without compromising retention of the starch in the formed mat and distribution of the starch in the Z-direction is improved which improves the strength properties of the paper and paperboard.

26 Claims, 1 Drawing Sheet

STARCH RETENTION IN PAPER AND BOARD PRODUCTION

BACKGROUND OF THE INVENTION

The present invention relates generally to the field of papermaking and, more specifically, to the retention of additives to the papermaking furnish or stock.

Paper and board are produced by forming a fiber mat from an aqueous cellulosic slurry on a wire screen. More specifically, as illustrated in FIG. 1, a papermaking system 10 includes a head box 11 which comprises a flow chamber located at an upstream end of a wire screen 12. The head box 11 receives a diluted cellulosic stock slurry referred to as a thin stock from a line 13 and deposits the thin stock slurry onto the wire screen 12. A paper or board mat is formed on the wire screen 12 and is transported out of the system at 14.

The thin stock that flows into the head box 11 typically includes less than 1% of solids, and therefore a large portion of the liquid is drained off the mat at the screen 12 and circulated through the line 15 to the silo shown at 16. This recirculated fluid is typically referred to as the white water and includes fines and fillers at a consistency typically between 0.05–0.5%.

In order to increase the strength of the final product especially in the recycled board production, large quantities of starch are added to the thin stock. The starch acts as a strength additive. Therefore, one of the important aspects of the papermaking process is the ability to retain the starch and other components added to the thin stock within the fiber mat that is formed on the wire screen 12.

Recirculation of the starch into the white water is inefficient for providing strength benefits and can cause a number of sanitation problems because the starch can break down into sugars and encourage the growth of bacteria in the system 10. Excessive amount of starch in the recycled white water also can increase the biological oxygen demand (BOD) in paper mill effluent. Residual starch in the white water can also increase the chemical oxygen demand (COD) or the amount of oxygen required to oxidize organic and oxidizable inorganic compounds in paper mill effluent. If a mill exceeds the government imposed BOD or COD limits, the mill can be subject to substantial fines.

Starch is generally provided in an uncooked and granular form and it must be gelled sometime during the papermaking process. Where large quantities of starch have to be applied often, paper manufacturers prefer using uncooked starch as opposed to cooked starch.

One method of improving the retention of granular starch in the fiber mat is the employment of a retention systems that employ coagulants and flocculants. Coagulants are low molecular weight cationic synthetic polymers or cationic starches that are added to the stock. Coagulants generally reduce the negative surface charges presented on granular starch particles and other particles in the stock and accomplish a degree of agglomeration of these particles.

Flocculants, on the other hand, are generally high molecular weight synthetic polymers operating via a bridging mechanism which creates larger agglomerates. The resulting agglomerates are then more easily entrapped in the formed web and therefore retention is improved. In contrast, unagglomorated small particles and starch granules would tend to pass through the web and back into the white water line 15.

While the use of flocculants enhances retention, they can have an adverse effect on formation. Formation is a measure of the uniformity of mass distribution within the paper sheet.

A high variance of mass distribution is indicative of poor formation and therefore poor sheet or board quality. The use of retention aides such as coagulants and flocculant, while increasing retention, can also adversely affect formation. Hence, the need for a reasonable degree of formation is often a limiting factor in achieving higher levels of retention.

Therefore, there is a persisting need for an improved method of manufacturing of paper products with large quantities of starch which provides improved retention of the starch in the web while not adversely affecting formation of the mat or sheet.

SUMMARY OF THE INVENTION

The present invention provides a solution to the aforenoted problem by providing an improved method of making paper or paperboard which results in high retention of starch in the formed web with minimized effect on the formation qualities of the mat. The method of the present invention comprises the steps of providing a starch slurry by pre-mixing starch with an aqueous solution containing at least some cellulosic fibers, mixing a flocculant with the starch solution to provide a preflocculated starch slurry, combining the preflocculated starch slurry with at least one stream comprising water and additional cellulosic fibers to form the thin stock suspension and thereafter draining the thin stock suspension on the wire screen to form the sheet. In this method, concentration of starch in the preflocculation stage can range from 50% to 99%.

In an embodiment, the method of the present invention further comprises the step of adding a coagulant to the preflocculated starch slurry.

In an embodiment, the method of the present invention further comprises the step of adding bentonite to the preflocculated starch slurry.

In an embodiment, the water source used to make the preflocculated starch slurry is a split stream of recycled white water that typically comprises water and cellulosic fibers in an amount ranging from about 0.05% to about 0.5% by weight.

In an embodiment, the water source used to make the preflocculated starch slurry is a split stream of a thick stock suspension comprising water and cellulosic fibers in an amount typically ranging from about 2% to about 5% by weight.

In an embodiment, the aqueous suspension used to make the preflocculated starch slurry comprises cellulosic material in an amount greater than 0.1% by weight.

In an embodiment, the method of the present invention includes the steps of providing a starch slurry by mixing starch with an aqueous solution containing cellulosic fibers, mixing a flocculant with the starch solution to provide a preflocculated starch slurry, providing a recycled white water stream comprising water and cellulosic fibers, providing a thick stock stream comprising water and cellulosic fibers, combining the preflocculated starch slurry, the white water stream and the thick stock stream to form a thin stock suspension and, thereafter, draining the thin stock suspension on a wire screen to form a sheet or web.

It is therefore an advantage of the present invention to provide a method of making paper and paperboard which improves the retention of granular starch without adversely affecting formation.

Another advantage of the present invention is that it provides a method of manufacturing paper and paperboard with increased starch retention.

Another advantage of the present invention is that it provides a method of manufacturing paper and paperboard with improved formation qualities.

Yet another advantage of the present invention is that it provides an improved method of preflocculating starch used in papermaking and paperboard making processes.

Still another advantage of the present invention is that it provides an improved method of preflocculating starch by combining granular starch with a low amount of cellulosic fibers in an aqueous slurry prior to the exposure of the starch to flocculant which results in an improved agglomeration of the starch and fibers resulting in improved retention yet maintained formation qualities. Such a co-agglomeration is a is a significantly improved approach over pretreatment of granular starch described previously. Specifically, the co-agglomeration provides better distribution and, less two-sided starch distribution, and improved interply bonding.

Another advantage of the present invention is that it provides improved starch distribution in the Z-direction which improves the starch properties of the board or paper.

Other objects and advantages of the invention will become apparent upon reading the following detailed description and appended claims, and upon reference to the accompanying figure.

DETAILED DESCRIPTION OF THE PRESENTLY PREFERRED EMBODIMENTS

Figure 1:
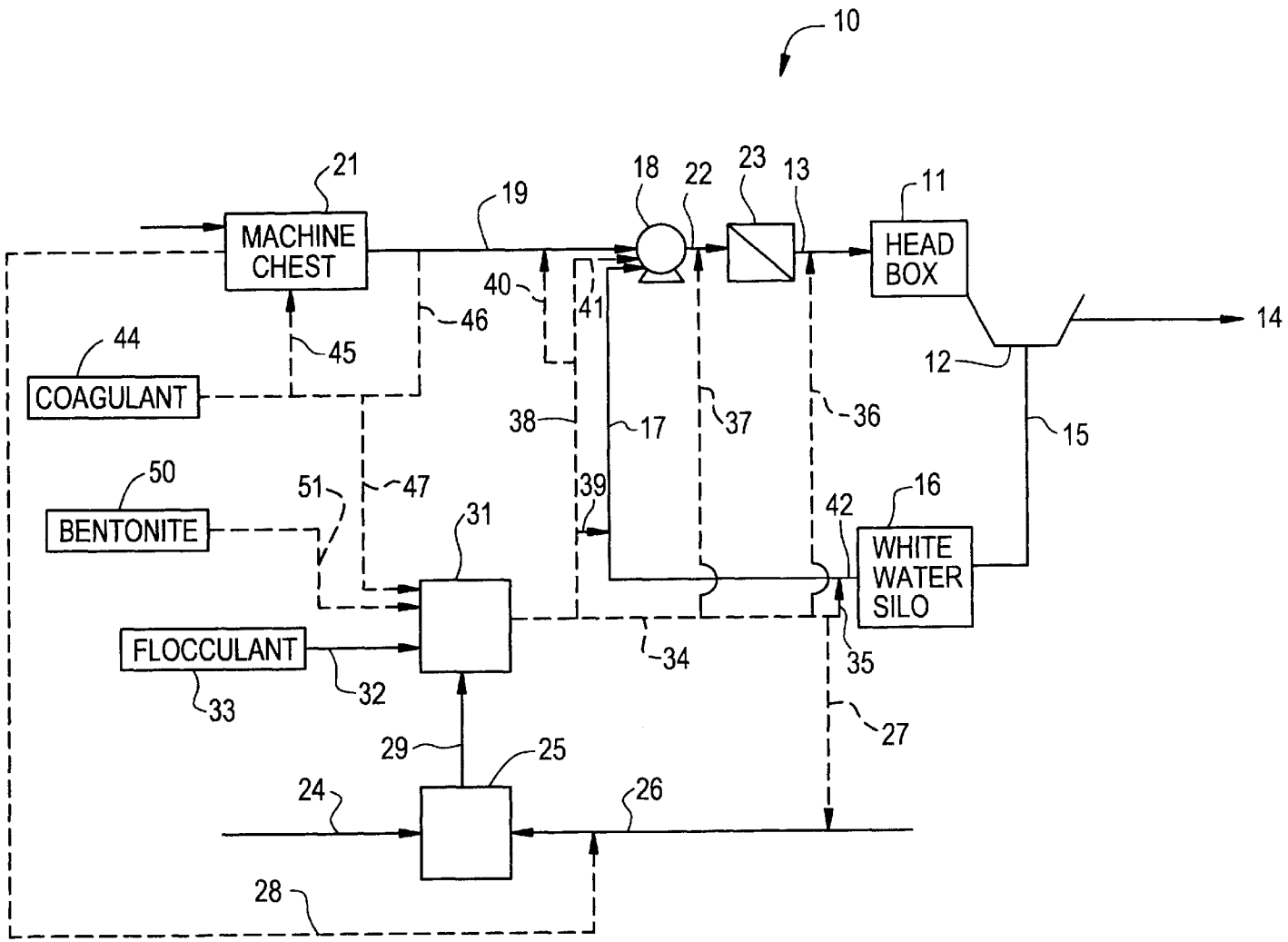
FIG. 1 illustrates, schematically, a papermaking system which incorporates the methods of the present invention.

The present invention provides an improved method of utilizing preflocculated starch as an additive in paper and paperboard production. A number of possible embodiments are illustrated in FIG. 1. It will also be noted that FIG. 1 illustrates just one of many different paper and board making processes to which the present invention applies. The use of FIG. 1 for illustration purposes is not intended to limit the methods of the present invention to the processes illustrated in FIG. 1. Rather, the inventive methods can be used to improve board and paper making processes for dual former machines, gap former machines and other machines in addition to the Fourdrinier processes illustrated in FIG. 1.

As discussed above, thin stock is delivered from the line 13 to the head box 11 which deposits the thin stock on the wire screen 12. A web or mat is formed on the wire screen 12 which is dried to provide a sheet of paper or board at 14. The excess liquid from the thin stock is filtered through the web and is referred to as white water which is recycled through the line 15 to the white water silo 16. In a conventional system, white water is typically returned through the line 17 to the fan pump 18 where it is combined with thick stock supplied through the line 19 and from the machine chest 21. The fan pump 18 mixes the white water and thin stock to form a thin stock suspension in the line 22 which is pumped through one or more additional shear stages such as the pressure screen shown at 23 and vortex cleaners (not shown) before the thin stock is delivered to the head box 11 through the line 13. Thus, prior to delivery to the head box 11, the thin stock is exposed to a plurality of shear stages including the fan pump 18, the pressure screens 23 and vortex cleaners (not shown).

Depending upon the condition of the starch additive, i.e. either cooked or granular, the starch may be added at a variety of points. In order to enhance the flocculation or agglomeration of the starch granules and to increase the possibility of retention, the starch granules have been mixed with flocculant prior to injection into the system 10. However, as discussed above, this procedure is still deemed insufficient due to the poor agglomeration of granulated starch.

Accordingly, the present invention provides an improved method of preflocculating starch by combining starch with an aqueous slurry that contains at least some cellulosic fibers.

It has been found, in accordance with the present invention, that the premixing of granulated starch with cellulosic fibers in an aqueous solution prior to the mixing of the starch with a flocculant enhances the agglomeration of the granulated starch in the papermaking system 10 and therefore enhances retention of the granulated starch. As noted above, starch retention is extremely important in paper and paperboard making processes. Further, it has been found that the preflocculation of the starch in the presence of small amounts of cellulosic fibers and then exposing the starch to a flocculant provides good agglomeration without adversely affecting formation.

An aqueous solution containing cellulosic fibers can be provided from a variety of sources. For example, white water may be utilized as illustrated by the connecting line 27 between the line 26 and the white water silo 16. White water is a good aqueous slurry source because it typically includes cellulosic materials in an amount ranging from about 0.1% to about 0.5%, depending upon the mill, pulp and product being manufactured.

Another suitable source of an aqueous slurry containing cellulosic fibers is thick stock. Further, the fact that a coagulant may have already been added to the thick stock does not adversely affect the agglomeration of the starch and, in fact, enhances the agglomeration as discussed below.

Still another suitable source of aqueous cellulosic fibers is a slurry of aqueous cellulosic fibers that may be supplied directly through the line 26 that may be in communication with another source of aqueous fibers elsewhere in the plant. The starch and aqueous solution of cellulosic fibers are combined in the vessel 25 or are mixed in a continuous manner in the line 29 which eliminates the need for the vessel 25. The suspension is then pumped through the line 29 to the mixing vessel 31 where it is combined with flocculant drawn through the line 32 from the flocculant supply 33. The flocculant, starch and aqueous cellulosic fibers are combined in the vessel 31 where the agglomeration process begins. Further, instead of using a mixing vessel 31 or a batch-type process, the flocculant, starch and fibers can be mixed in a continuous manner.

The preflocculated slurry of starch and fibers/lines in the vessel 31 may be added to the papermaking system 10 at a variety of different points as illustrated by the lines 34–41, all shown in phantom. Specifically, one suitable entry point is the outlet 42 of the white water silo. Accordingly, the flocculant/starch/cellulosic fiber mixture may be pumped through the line 34 and line 35 to the outlet 42 of the white water silo 16. The preflocculated mixture may also be added between the pressure screen 23 and head box 11 as illustrated by the line 36. The mixture may also be added between the fan pump 18 and pressure screen 23 as illustrated by the line 37.

Accordingly, the mixture may be added to white water, or to the thin stock, before or after pressure screens or to the thick stock before dilution with white water or to the thin stock after thick stock dilution, before or after the pressure screens.

The pre-agglomeration of starch will be additionally enhanced through addition of coagulant and/or bentonite to starch mix before adding it to the papermaking system.

If additional shear stages such as vortex cleaners are included in the system, the mixture may be added between the pressure screen and vortex cleaner as well. Still further, the mixture may be added at a point in the white water loop downstream from the outlet 42 of the white water silo 16. As shown by the lines 38 and 39, the mixture may be injected at any point between the white water outlet 42 and the fan pump 18. Further, as illustrated by the lines 38 and 40, the mixture may be added to the line 19, between the machine chest 21 and fan pump 18. Still further, as illustrated by the lines 38 and 41, the mixture may be added directly at the fan pump 18 where it is mixed with the white water and thick stock.

As noted above, if thick stock is used as the aqueous solution for pre-mixing with the starch in the vessel 25, coagulant may already be present in the thick stock. If not, coagulant may be added to the system from a coagulant coagulant supply 44 to the machine chest 21 through a line 45, to the line 19 connecting the machine chest 21 to the fan pump 18 through the line 46 or into the mixing vessel 31 through the line 47. As noted above, the coagulant will enhance agglomeration and, if the amounts are properly controlled, will not adversely affect formation.

Finally, bentonite may also be provided from a bentonite supply 50 through a line 51 to the mixing chamber 31. It has been found that the addition of bentonite to the system 10 prior to the shear stages including the fan pump 18 and pressure screens 23 can assist in the retention of the bentonite without adversely affecting formation.

EXAMPLES

Studies were performed to test the efficacy of preflocculating the starch with an aqueous slurry containing cellulosic fibers as opposed to earlier described flocculation techniques where the starch and flocculant are added to the system separately or a preflocculation technique for the starch and flocculant are mixed without the presence of pulp or cellulosic fibers. The starch used in the study is a granular corn starch at a dosage rate of 5% by weight. The furnish or stock consisted of 0.8% by weight pulp prepared from tap water combined with a 3.12% thick stock. The flocculant chosen for the study is a cationic latex polymer which is copolymer of acrylamide and dimethylaminoethylacrylate quarternized with methyl chloride or DMAEA-MCQ (80/20 mole %). The reduced specific viscosity (RSV) range from 19–25.

A Britt Jar test was employed using a Britt CF Dynamic Drainage jar consisting of an upper chamber of about 1 liter capacity in a bottom drainage chamber. The chambers are separated by a support screen and a drainage screen. A downward extending tube is disposed below the drainage chamber and is equipped with a clamp for closure. The upper chamber is provided with a variable speed, high torque motor equipped with a two-inch three-bladed propeller to create controlled shear conditions in the upper chamber. The tests were conducted by placing the 0.8% stock in the upper chamber and exposing the stock to shear stirring for 5 seconds. Then, the starch was added. For Examples 2, 3 and 4, the flocculant was added after 15 seconds and after 20 seconds, the mixture was drained.

It will be noted that flocculant and coagulant choice is very mill specific and pulp specific. Accordingly, while the examples below utilize only one flocculant, other flocculants are known and can be used with the method of the present invention. Choosing the appropriate flocculant for a specific mill design and pulp supply is within the knowledge of those skilled in the art.

Example 1

Example 1 served as a blank. 500 ml of stock and a pre-mixture of 3.4 ml of 5.95% starch and 10 ml of water with no polymer was added to the upper chamber. 40 ml of filtrate was collected at the end of the experiment for starch determination with KI-$I_2$.

Example 2

In Example 2, a standard flocculation was conducted as follows. Again, 500 ml of stock and a pre-mixture of 3.4 ml of 5.95% starch in 10 ml of water and 1.5 kg/t (or 6 ml 0.1%) of flocculant was added to the upper chamber. At the end of the above described sequence, 40 ml of filtrate was collected for starch determination with KI-$I_2$.

Example 3

In Example 3, a preflocculation of the starch without pulp was conducted. To 500 ml of stock, a preflocculated solution prepared by adding 0.3 kg/t (or 1.2 ml 0.1%) flocculant to a pre-mixture of 3.4 ml 5.9% starch in 10 ml water was added to the mixture. An additional 1.2 kg/t (or 4.8 ml 0.1%) flocculant was added. 40 ml of the filtrate was collected at the end of the sequence of for starch determination with KI-$I_2$.

Example 4

In Example 4, a preflocculation of the starch in the presence of pulp was conducted in accordance with the present invention. To 500 ml of stock, a preflocculated solution was added by combining 0.42 kg/t (or 2.1 ml 0.1%) flocculant to a pre-mixture of 50 ml stock and 3.4 ml 5.95% starch in 10 ml of water. An additional 1.08 kg/t (or 3.9 ml) of flocculant was added. After the above-described sequence, 40 ml of filtrate was collected for starch determination with KI-$I_2$.

The results of the starch determination for Examples 1–4 are presented below in Table 1.

TABLE 1

| | Total vol. (ml) | Ckd. star. (ml) | Water (ml) | KI-$I_2$ soln (ml) | 0.6 N HCl (ml) | Abs.@580 (A) |
|---|---|---|---|---|---|---|
| Example 1 | 100 | 2 | 48 | 10 | 40 | 0.457 |
| Example 2 | 100 | 2 | 48 | 10 | 40 | 0.395 |
| Example 3 | 100 | 2 | 48 | 10 | 40 | 0.330 |
| Example 4 | 100 | 2 | 48 | 10 | 40 | 0.350 |

The results of Table 1 indicate that preflocculation of starch both with (Example 4) and without (Example 3) the presence of pulp enhanced retention of the starch. However, a visual examination of the mat formed on the support screen of the Britt Jar revealed that preflocculation of the starch with the presence of pulp (Example 4) when compared to preflocculation of the starch without the presence of pulp (Example 3) results in a near equivalent retention but with a superior formation.

Thus, formation is enhanced by preflocculating the starch with the presence of pulp and the enhanced formation does not come at the expense of substantially reduced retention. Accordingly, the present invention, as illustrated in Example 4, provides an improved method of preflocculating starch results in superior retention and formation, a combination which has not been previously possible.

In addition to improving starch retention, the present invention also provides improved starch distribution which is expected to substantially offset and adverse effects on formation that would otherwise occur with the use of increased flocculant dosages. Further, it is anticipated that the flocculant dosage could be increased even more resulting in still increased starch retention while maintaining formation at an acceptable level.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

What is claimed:

1. A method of improving retention of granular starch in paper and paperboard production, the method comprising the following steps:

mixing starch with an aqueous slurry containing cellulosic fibers to provide a starch/cellulosic fiber slurry, the aqueous slurry containing cellulosic fibers consisting of a split stream of recycled white water, mixing a flocculant with the starch/cellulosic fiber slurry to provide a preflocculated starch slurry, combining the preflocculated starch slurry with a papermaking furnish.

2. The method of claim 1 further comprising the step of adding a coagulant to the preflocculated starch slurry prior to the combining step.

3. The method of claim 1 further comprising the following steps prior to the combining step:

adding a coagulant to the preflocculated starch slurry, followed by the step of adding additional flocculant to the preflocculated slurry.

4. The method of claim 1 further comprising the step of adding bentonite to the preflocculated starch solution prior to the combining step.

5. The method of claim 1 further comprising the following step prior to the combining step:

adding bentonite to the preflocculated starch solution, followed by the step of adding coagulant to the preflocculated starch solution.

6. The method of claim 1 further comprising the following steps prior to the combining step: p1 adding bentonite to the preflocculated starch solution, followed by the steps of adding coagulant to the preflocculated starch solution, and adding additional flocculant to the preflocculated starch solution.

7. The method of claim 1 wherein the aqueous slurry containing cellulosic fibers is a split stream of recycled white water comprising water and cellulosic fibers in an amount ranging from about 0.05% to about 0.5% by weight.

8. The method of claim 1 wherein the aqueous slurry containing cellulosic fbers is a split stream of recycled white water comprising water and cellulosic fibers in an amount greater than 0.1% by weight.

9. The method of claim 1 wherein the step of combining the preflocculated starch slurry with a papermaking furnish further comprises adding the preflocculated starch slurry to a white water stream.

10. The method of claim 1 wherein the step of combining the preflocculated starch slurry with a papermaking furnish further comprises adding the preflocculated starch slurry to a white water stream that is being pumped towards a head box.

11. The method of claim 1 wherein the step of combining the preflocculated starch slurry with a papermaking furnish further comprises adding the preflocculated starch slurry to a thin stock stream that is being pumped into a pressure screen apparatus.

12. The method of claim 1 wherein the step of combining the preflocculated starch slurry with a papermaking furnish further comprises adding the preflocculated starch slurry to a thin stock stream that is being pumped from a pressure screen apparatus towards a head box.

13. The method of claim 1 wherein the step of combining the preflocculated starch slurry with a papermaking furnish further comprises adding the preflocculated starch slurry to a thick stock stream prior to combining the thick stock stream with a white water stream.

14. A method of improving retention of granular starch in paper and paperboard production that includes depositing a thin stock slurry onto a wire screen to form a mat on the screen, the method comprising the following steps:

mixing granular starch with an aqueous slurry containing cellulosic fibers to provide a starch/cellulosic fiber slurry, the aqueous slurry containing cellulosic fibers consisting of a split stream of recycled white water, mixing a flocculant with the starch/cellulosic fiber slurry to provide a preflocculated starch slurry, combining the preflocculated starch slurry with a papermaking furnish comprising a primary recycled white water stream and thick stock stream to form the thin stock slurry, draining the thin stock slurry on the wire screen to form the mat.

15. The method of claim 14 further comprising the step of adding a coagulant to the preflocculated starch slurry prior to the combining step.

16. The method of claim 14 further comprising the following steps prior to the combining step:

adding a coagulant to the preflocculated starch slurry, followed by the step of adding additional flocculant to the preflocculated slurry.

17. The method of claim 14 further comprising the step of adding bentonite to the preflocculated starch solution prior to the combining step.

18. The method of claim 14 further comprising the following steps prior to the combining step:

adding bentonite to the preflocculated starch solution, followed by the step of adding coagulant to the preflocculated starch solution.

19. The method of claim 14 further comprising the following steps prior to the combining step:

adding bentonite to the preflocculated starch solution, followed by the steps of adding coagulant to the preflocculated starch solution, and adding additional flocculant to the preflocculated starch solution.

20. The method of claim 14 wherein the aqueous slurry containing cellulosic fibers is a split stream of recycled white water comprising water and cellulosic fibers in an amount ranging from about 0.05% to about 0.5% by weight.

21. The method of claim 14 wherein the aqueous slurry containing cellulosic fibers is a split stream of recycled white water comprising water and cellulosic fibers in an amount greater than 0.1% by weight.

22. The method of claim 14 wherein the step of combining the preflocculated starch slurry with a papermaking furnish further comprises adding the preflocculated starch slurry to a white water stream.

23. The method of claim 14 wherein the step of combining the preflocculated starch slurry with a papermaking furnish further comprises adding the preflocculated starch slurry to a white water stream that is being pumped towards a head box.

24. The method of claim 14 wherein the step of combining the preflocculated starch slurry with a papermaking furnish further comprises adding the preflocculated starch slurry to a thin stock stream that is being pumped into a pressure screen apparatus.

25. The method of claim 14 wherein the step of combining the preflocculated starch slurry with a papermaking furnish further comprises adding the preflocculated starch slurry to a thin stock stream that is being pumped from a pressure screen apparatus towards a head box.

26. The method of claim 14 wherein the step of combining the preflocculated starch slurry with a papermaking furnish further comprises adding the preflocculated starch slurry to a thick stock stream prior to combining the thick stock stream with a white water stream.

* * * * *